US007676052B1

(12) United States Patent
Ma et al.

(10) Patent No.: US 7,676,052 B1
(45) Date of Patent: Mar. 9, 2010

(54) DIFFERENTIAL MICROPHONE ASSEMBLY

(75) Inventors: Wei Ma, San Ramon, CA (US); Ahmad Bahai, Lafayette, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 960 days.

(21) Appl. No.: 11/307,932

(22) Filed: Feb. 28, 2006

(51) Int. Cl.
*H04R 25/00* (2006.01)

(52) U.S. Cl. ..... 381/356; 381/92; 381/357; 381/369

(58) Field of Classification Search ..... 381/91, 381/92, 122, 313, 355, 356, 357, 358, 360, 381/369, 361
See application file for complete search history.

(56) References Cited

U.S. PATENT DOCUMENTS 4,633,045 A 12/1986 Bartlett
4,965,775 A 10/1990 Elko et al.
5,303,307 A 4/1994 Elko et al.
5,473,684 A 12/1995 Bartlett et al.
5,546,458 A 8/1996 Iwami
5,586,191 A 12/1996 Elko et al.
5,748,757 A 5/1998 Kubli et al.
6,041,127 A 3/2000 Elko
6,151,399 A * 11/2000 Killion et al. ..... 381/313
6,584,203 B2 6/2003 Elko et al.
6,831,987 B2 * 12/2004 Killion et al. ..... 381/313
7,068,801 B1 6/2006 Stinson et al.

* cited by examiner

*Primary Examiner*—Huyen D Le
(74) *Attorney, Agent, or Firm*—Vedder Price P.C.

(57) ABSTRACT

A differential microphone assembly with multiple membranes in a single package and oriented in mutually exclusive directions.

7 Claims, 2 Drawing Sheets

DIFFERENTIAL MICROPHONE ASSEMBLY

BACKGROUND OF THE INVENTION

1. Field of Invention

The present invention relates to microphones, and in particular, to close-talk differential microphone arrays.

2. Description of the Related Art

With the seemingly ever increasing popularity of cellular telephones, as well as personal digital assistances (PDAs) providing voice recording capability, it has become increasingly important to have noise canceling microphones capable of operating in noisy acoustic environments. Further, even in the absence of excessive background noise, noise canceling microphones are nonetheless highly desirable for certain applications, such as speech recognition devices and high fidelity microphones for studio and live performance uses.

Such microphones are often referred to as pressure gradient or first order differential (FOD) microphones, and have a diaphragm which vibrates in accordance with differences in sound pressure between its front and rear surfaces. This allows such a microphone to discriminate against airborne and solid-borne sounds based upon the direction from which such noise is received relative to a reference axis of the microphone. Additionally, such a microphone can distinguish between sound originating close to and more distant from the microphone.

For the aforementioned applications, so called close-talk microphones, i.e., microphones which are positioned as close to the mouth of the speaker as possible, are seeing increasing use. In particular, multiple microphones are increasingly configured in the form of a close-talking differential microphone array (CTDMA), which inherently provide low frequency far field noise attenuation. Accordingly, a CTDMA advantageously cancels far field noise, while effectively accentuating the voice of the close talker, thereby spatially enhancing speech quality while minimizing background noise. (Further discussion of these types of microphones can be found in U.S. Pat. Nos. 5,473,684, and 5,586,191, the disclosures of which are incorporated herein by reference.)

Difficulties with differential microphone arrays include mutual separations of two or more microphones at relatively large distances (e.g., 1.5 centimeters), thereby making it difficult to package multiple microphones together in a practical manner. Additionally, when the processing and noise suppression circuitry is added, generally in a separate package, the wiring between packages causes additional interference and mismatching. Moreover, differential microphone arrays typically have a high pass frequency characteristic for which compensation, equalization or pre-emphasis may be necessary.

SUMMARY OF THE INVENTION

In accordance with the presently claimed invention, a differential microphone assembly is provided with multiple membranes in a single package and oriented in mutually exclusive directions.

In accordance with one embodiment of the presently claimed invention, an apparatus with a differential microphone assembly for converting an acoustic pressure field emitted by a source to one or more electrical signals includes a substrate, processing circuitry and a plurality of acoustic transducers. The processing circuitry is disposed on the substrate and responsive to a plurality of transducer signals corresponding to a received acoustic pressure field by providing one or more corresponding output signals. The acoustic transducers are mutually coupled mechanically, collectively coupled mechanically to the substrate, collectively coupled electrically to the processing circuitry, and responsive to the received acoustic pressure field by providing the plurality of transducer signals. Each one of the plurality of mutually coupled acoustic transducers includes a membrane having an orientation, and each one of the plurality of membrane orientations is at least approximately orthogonal to a respective one of a plurality of substantially mutually exclusive directions.

In accordance with another embodiment of the presently claimed invention, an apparatus with a differential microphone assembly for converting an acoustic pressure field emitted by a source to one or more electrical signals includes support means, processor means and acoustic transducer means. The processor means is for processing a plurality of transducer signals corresponding to a received acoustic pressure field and to provide one or more corresponding output signals. The acoustic transducer means, coupled mechanically to the support means and electrically to the processor means, is for converting the received acoustic pressure field to the plurality of transducer signals. The acoustic transducer means includes a plurality of membrane means having respective orientations, and each one of the plurality of membrane means orientations is at least approximately orthogonal to a respective one of a plurality of substantially mutually exclusive directions.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

Figures 1, 2:
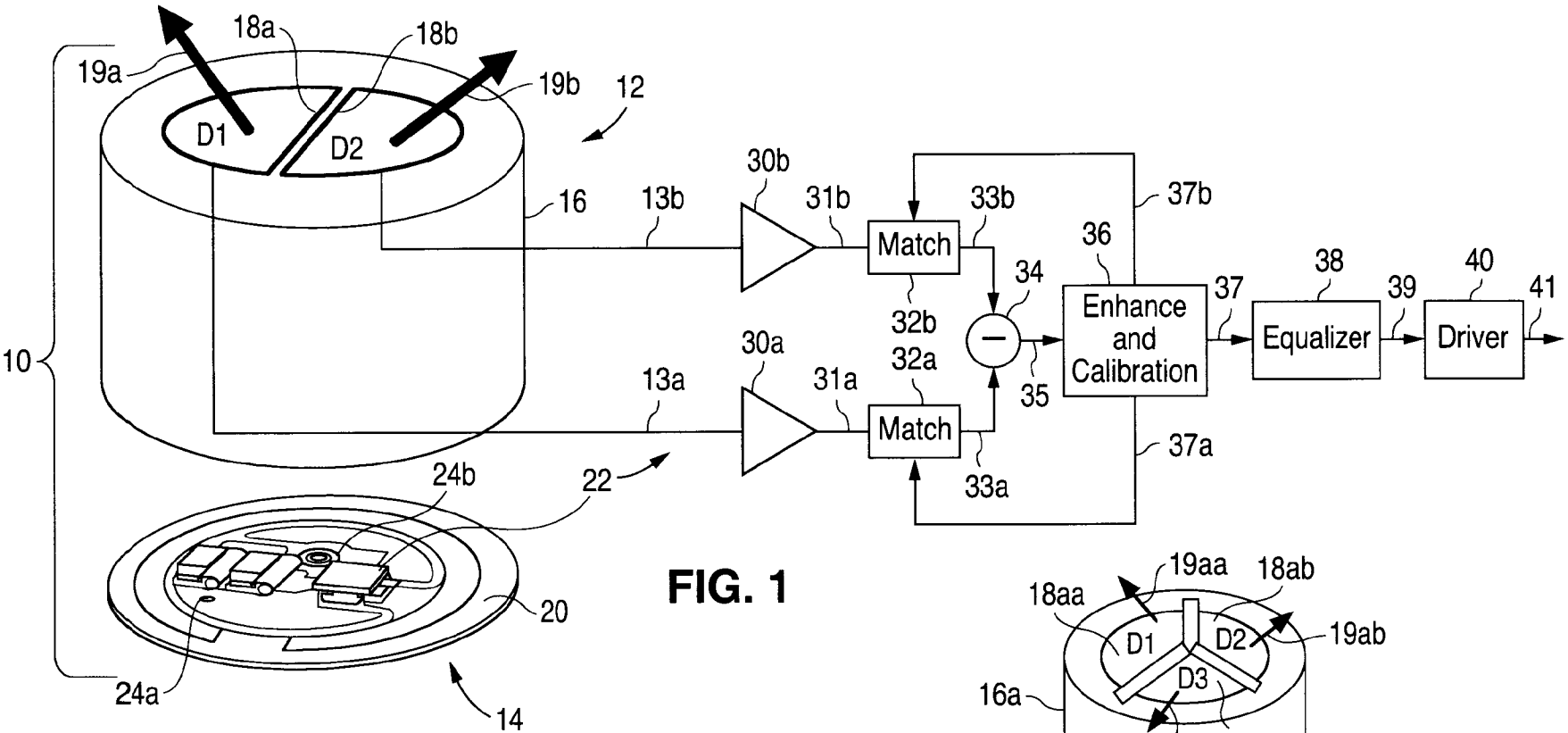
FIG. 1 is a combined mechanical and schematic drawing depicting the packaging and processing circuitry of a differential microphone assembly in accordance with one embodiment of the presently claimed invention.
FIG. 2 is a mechanical drawing depicting the packaging portion of a differential microphone assembly in accordance with an alternative embodiment of the presently claimed invention.

Referring to FIG. 1, a differential microphone assembly 12 in accordance with one embodiment of the presently claimed invention includes a microphone housing assembly 16 and circuit assembly 14. The circuit assembly 14 includes a substrate 20 (e.g., a semiconductor substrate, printed wiring board, printed circuit card, or the like) on which the processing circuitry is mounted and to which the housing assembly 16 is mechanically coupled (e.g., about the periphery of the bottom surface of the housing assembly 16 and the corresponding upper surface periphery of the substrate 20). Electrodes 24*a*, 24*b* provide for electrical coupling between the microphones within the housing assembly 16 and the processing circuitry 22. In this embodiment, two microphones are included, each having a diaphragm 18*a*, 18*b* oriented in mutually exclusive, e.g., substantially opposing, directions 19*a* and 19*b*.

The output signals 13*a* and 13*b* from the microphones are amplified by pre-amplifiers 30*a*, 30*b*. The amplified microphone signals 31*a*, 31*b* are processed by matching circuits 32*a*, 32*b* (e.g., controllable filters). The resulting signals 33*a*, 33*b* are differentially summed in a subtraction circuit 34. The resultant signal 35 is processed with circuitry 36 that introduces enhancement and calibration as desired. The resultant signal 37 is equalized by equalization circuitry 38, following which the equalized signal 39 is amplified by a driver circuit 40 to produce the final output signal 41. The enhancement and calibration circuitry 36 also provides control signals 37*a*, 37*b* for the matching circuits 32*a*, 32*b*.

Figure 1A:
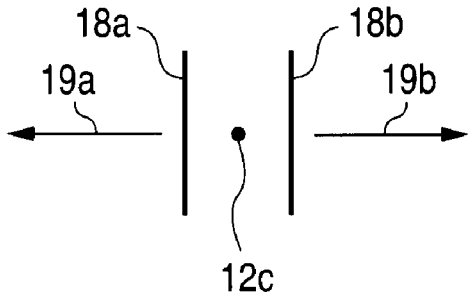
FIGS. 1A and 1B illustrate alternative microphone diaphragm orientations for the microphone assembly of FIG. 1.
Figure 1B:
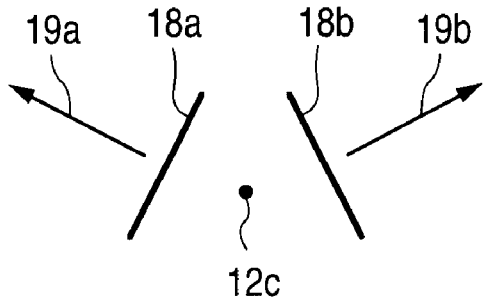

Referring to FIGS. 1A and 1B, in the case of a dual microphone assembly, the orientation of the diaphragms 18*a*, 18*b* are selected to be such that the surfaces of the diaphragms 18*a*, 18*b* are orthogonal to mutually exclusive directions 19*a* 19*b*. This can mean that the diaphragms 18*a*, 18*b* are parallel, as shown in FIG. 1A, or non-parallel, as shown in FIG. 1B. With two diaphragms, it is expected that the directions 19*a*, 19*b* of orientation correspond to radii originating from the center 12*c* of the microphone assembly 12.

Referring to FIG. 2, according to an alternative embodiment of the presently claimed invention, more microphones can be used e.g., three microphones as shown. The three diaphragms, 18*aa*, 18*ab* and 18*ac* are oriented to face three mutually exclusive directions 19*aa*, 19*ab* and 19*ac* within the housing assembly 16*a*.

Figure 2A:
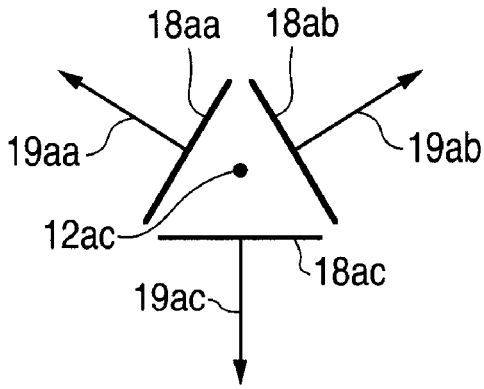
FIGS. 2A and 2B illustrate examples of alternative microphone diaphragm orientations for the microphone assembly of FIG. 2.
Figure 2B:
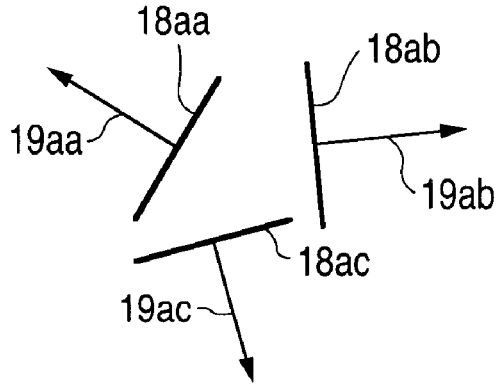

Referring to FIGS. 2*a* and 2*b*, in the case of a three-microphone assembly, the diaphragms 18*aa*, 18*ab*, 18*ac* can be arranged in a regular pattern, such as that shown in FIG. 2A, in which the directions of orientation 19*aa*, 19*ab*, 19*ac* correspond to radii of the center 12*ac* of the microphone assembly 12*a*. Alternatively, the diaphragms 18*aa*, 18*ab*, 18*ac* can be arranged in an irregular manner, such as that shown in FIG. 2B, in which case the directions of orientation 19*aa*, 19*ab*, 19*ac* need not necessarily correspond to radii of the microphone assembly 12*a*.

In accordance with the foregoing discussion, a differential microphone assembly in accordance with the presently claimed invention includes multiple microphones with transducers which are mutually coupled mechanically, e.g., housed in a common package, with the diaphragms of the transducers oriented in mutually exclusive directions. It will be readily appreciated by one of ordinary skill in the art that the orientations of the diaphragms can be static, i.e., permanently orientated in predetermined directions, or dynamic, e.g., controllable by charging the diaphragms with phantom power. Additionally, distortions in frequency response of the microphones can be compensated by orienting the transducer diaphragms in a manner appropriate for the application (e.g., cellular telephone or PDA), as well as charging them with phantom power. For example, a differential microphone assembly in accordance with the presently claimed invention can be implemented as a pressure differential microphone with airways communicating with both sides of the diaphragms 18*a*, 18*b*, 18*aa*, 18*ab*, 18*ac* (FIGS. 1 and 2), e.g., airways through the substrate 20 or periphery of the housing assembly 16, 16*a* in addition to the airways as shown through the top of the housing assembly 16, 16*a*. Such airway(s) allow sounds to impinge upon both sides of the diaphragms 18*a*, 18*b*, 18*aa*, 18*ab*, 18*ac*, thereby causing substantial cancellation of far field pressures upon the diaphragms 18*a*, 18*b*, 18*aa*, 18*ab*, 18*ac*.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a differential microphone assembly for converting an acoustic pressure field emitted by a source to one or more electrical signals, comprising:

a substrate;

processing circuitry disposed on said substrate, responsive to a plurality of transducer signals corresponding to a received acoustic pressure field by providing one or more corresponding output signals and including amplifier circuitry responsive to said plurality of transducer signals by providing a plurality of buffered signals, signal combining circuitry coupled to said amplifier circuitry and responsive to said plurality of buffered signals by providing at least one combination signal, and signal enhancement circuitry coupled to said signal combining circuitry and responsive to said at least one combination signal by providing at least one of said one or more corresponding output signals; and a plurality of acoustic transducers mutually coupled mechanically collectively coupled mechanically to said substrate, collectively coupled electrically to said processing circuitry and responsive to said received acoustic pressure field by providing said plurality of transducer signals, wherein each one of said plurality of mutually coupled acoustic transducers includes a membrane having an orientation, and each one of said plurality of membrane orientations is at least approximately orthogonal to a respective one of a plurality of substantially mutually exclusive directions.

2. The apparatus of claim 1, wherein said substrate comprises a semiconductor substrate.

3. The apparatus of claim 1, wherein said substrate comprises a printed circuit board.

4. The apparatus of claim 1, wherein at least one of said plurality of substantially mutually exclusive directions comprises a radius of said plurality of mutually coupled acoustic transducers.

5. The apparatus of claim 1, wherein said plurality of substantially mutually exclusive directions comprises a plurality of radii of said plurality of mutually coupled acoustic transducers.

6. The apparatus of claim 1, wherein mutually adjacent ones of said plurality of substantially mutually exclusive directions extend along substantially equal angular separations.

7. An apparatus including a differential microphone assembly for converting an acoustic pressure field emitted by a source to one or more electrical signals, comprising:

a substrate;

processing circuitry disposed on said substrate, responsive to a plurality of transducer signals corresponding to a received acoustic pressure field by providing one or more corresponding output signals, and including signal matching circuitry responsive to at least one control signal and said plurality of transducer signals by providing a plurality of matched signals, signal combining circuitry coupled to said signal matching circuitry and responsive to said plurality of matched signals by providing at least one combination signal; signal, and signal enhancement circuitry coupled to said signal combining circuitry and responsive to said at least one combination signal by providing said at least one control signal and at least one of said one or more corresponding output signals; and a plurality of acoustic transducers mutually coupled mechanically, collectively coupled mechanically to said substrate, collectively coupled electrically to said processing circuitry, and responsive to said received acoustic pressure field by providing said plurality of transducer signals, wherein each one of said plurality of mutually coupled acoustic transducers includes a membrane having an orientation, and each one of said plurality of membrane orientations is at least approximately orthogonal to a respective one of a plurality of substantially mutually exclusive directions.

* * * * *

UNITED STATES PATENT AND TRADEMARK OFFICE

CERTIFICATE OF CORRECTION

PATENT NO. : 7,676,052 B1
APPLICATION NO. : 11/307932
DATED : March 9, 2010
INVENTOR(S) : Wei Ma et al.

It is certified that error appears in the above-identified patent and that said Letters Patent is hereby corrected as shown below:

Claim 7, Column 6, Line 4
Please delete "...tion signal; signal, and"
and insert -- ...tion signal, and -- in its place.

Signed and Sealed this

Twentieth Day of April, 2010

David J. Kappos

David J. Kappos
*Director of the United States Patent and Trademark Office*